US005132033A

United States Patent [19]

Jao et al.

[11] Patent Number: 5,132,033

[45] Date of Patent: Jul. 21, 1992

[54] METHOD OF PREPARING OVERBASED CALCIUM SULFONATES

[75] Inventors: Tze C. Jao; Jayne M. Vaccaro, both of Fishkill, N.Y.; Elzie D. Black, Port Arthur, Tex.

[73] Assignee: Texaco Inc., White Plains, N.Y.

[21] Appl. No.: 607,960

[22] Filed: Nov. 1, 1990

[51] Int. Cl.[5] ..... C10M 135/10

[52] U.S. Cl. ..... 252/33; 252/18; 252/25

[58] Field of Search ..... 252/33, 18, 25

[56] References Cited

U.S. PATENT DOCUMENTS 4,879,053 11/1989 Matthews et al. ..... 252/18

4,954,272 9/1990 Jao et al. ..... 252/25

*Primary Examiner*—Brian E. Hearn

*Assistant Examiner*—Maria Nuzzolillo

*Attorney, Agent, or Firm*—Robert A. Kulason; James J. O'Loughlin; Carl G. Seutter

[57] ABSTRACT

Lubricating oils contain an overbased oil-soluble composition prepared by adding water to a heated reaction mixture containing an alkaline earth metal halide, an alkaline earth metal salt of an alkaryl sulfonate, a hydrocarbon diluent-solvent, a lower alkanol, and an alkali metal oxide, and thereafter passing carbon dioxide through the reaction mixture.

11 Claims, No Drawings

METHOD OF PREPARING OVERBASED CALCIUM SULFONATES

FIELD OF THE INVENTION

This invention relates to a method of preparing overbased calcium sulfonates which are used as additives to lubricating oils to provide detergency and reserve alkalinity.

BACKGROUND OF THE INVENTION

As is well known to those skilled in the art, lubricating oils which are used in internal combustion engines are degraded to acidic products which attack and corrode engine parts and catalyze the formation of sludge. As a result, the lubricity of the oil is reduced; and wear on the engine parts is accelerated.

In order to neutralize the effect of the acids so formed, it is desirable to add basic substances to the lubricating oil; and these neutralize the acids before they attain a high enough concentration to cause significant damage. Typical of the compositions which maybe added are colloidal carbonates of alkaline earth metals; and they are usually added as carbonate dispersions stabilized by oil-soluble surface active agents. These latter are commonly oil-soluble alkaline earth metal salts of sulfonated petroleum lubricating oil fractions—made by sulfonating lubricating oil fractions (of molecular weight of typically 350–600) or by sulfonating alkyl benzenes of desired molecular weight. Alkylated benzenes prepared from straight chain alkyl groups are preferred.

Preparation of overbased calcium sulfonates typically is effected by reacting an alkylbenzene sulfonic acid (dissolved in oil) with calcium oxide or calcium hydroxide and bubbling carbon dioxide through the reaction mixture. The final overbased product contains an excess of calcium carbonate together with a calcium sulfonate.

Overbased compositions may be characterized inter alia by Total Base Number (TBN) as determined by ASTM Test D-2896. This is the number of equivalent milligrams of KOH needed to neutralize one gram of sample to a pH of 7. Commonly the TBN may be 0-500.

U.S. Pat. No. 4,954,272 discloses the preparation of an overbased oil-soluble calcium sulfonate (having a TBN of 325) by (i) mixing a neutral calcium sulfonate with a hydrocarbon and a lower alkanol; (ii) adding CaO, $Ca(OH)_2$ and $H_2O$ in mole ratio of CaO to $Ca(OH_2)$ of about 9–0.25:1 and of $H_2O$ to CaO of about 0.15–0.30–1; (iii) heating to about 100° F.–170° F./0–50 psig; (iv) admitting carbon dioxide for 60–140 minutes; (v) adding diluent oil; (vi) separating solids from the solution of overbased sulfonate in oil and hydrocarbon; and (vii) stripping hydrocarbon.

U.S. Pat. No. 4,427,559 discloses that a mixture of calcium oxide and calcium hydroxide can be used in the overbased reaction to provide reserve alkalinity to neutral calcium sulfonates. It is reported that when mixtures containing up to 30 percent CaO are used, satisfactory 400 TBN overbased sulfonate products are obtained. When mixtures of 30 to 50 percent CaO are used, a gelatinous material which plugs the filter is obtained. Concentrations of CaO above 70 percent produce a fluid product containing finely divided particles which can not be filtered and which are reflective of light. In this regard, the patent teaches the criticality of the ratio of the calcium oxide the calcium hydroxide in the absence of a promoter in producing acceptable product.

Other references which may provide additional background may include

U.S. Pat. No. 4,810,396
U.S. Pat. No. 4,604,219
U.S. Pat. No. 4,165,291
U.S. Pat. No. 4,137,184
U.S. Pat. No. 4,824,584
U.S. Pat. No. 4,086,170

It is an object of this invention to provide an improved method of preparing overbased calcium sulfonates. Other objects will be apparent to those skilled in the art.

STATEMENT OF THE INVENTION

In accordance with certain of its aspects, this invention is directed to a method of preparing an overbased composition containing an oil-soluble alkaline earth metal salt of an alkaryl sufonate which comprises (i) forming a reaction mixture containing a neutral alkaline earth metal salt of an alkaryl sulfonate, an alkaline earth metal halide, a hydrocarbon diluent-solvent, a lower alkanol promoter, and an alkaline earth metal oxide;
(ii) heating said reaction mixture to 50° C.–70° C.;
(iii) adding water to said heated reaction mixture;
(iv) after termination of water addition, admitting gaseous carbon dioxide to said reaction mixture in molar amount less than the molar amount of alkaline earth metal oxide originally added to said mixture thereby forming an overbased composition containing an oil-soluble alkaline earth metal salt of an alkaryl sulfonate; and
(v) recovering said overbased composition containing an oil-soluble alkaline earth metal salt of an alkaryl sulfonate;

DESCRIPTION OF THE INVENTION

In practice of the process of this invention there are added to a reaction vessel 100 parts of a neutral alkaline earth metal salt of a sulfonated alkylated hydrocarbon containing at least one aromatic ring. These compositions may be obtained by sulfonation of a product formed by alkylating a hydrocarbon containing at least one aromatic ring.

Typically the product may be derived from a petroleum source and may contain a polycyclic nucleus including an aromatic ring condensed with 1–3 other rings which may be aromatic or 10–20 alicyclic. A $C_{10}$–$C_{20}$ chain may typically be bonded to a non-aromatic component of the ring system; and there is predominantly one long chain alkyl group per molecule. Sulfonation is thereafter effected to yield product predominantly containing one —$SO_3H$ group per molecule, the —$SO_3H$ group being bonded to the aromatic ring or to a non-aromatic ring. This product is converted to the neutral alkaline earth metal salt by adding two moles thereof to one mole of e.g. calcium hydroxide.

In the case of a synthetic composition, typified by those wherein the aromatic hydrocarbon is benzene or naphthalene, the alkyl group is typically a $C_{10}$–$C_{16}$ chain; and the predominant alkylated species may include two such groups per molecule. Sulfonation is effected to yield predominantly one —$SO_3H$ group per molecule—bonded to the aromatic ring.

Typically available commercial products which may be employed may included:

(i) The Witco Cal T brand of a mixture containing 65% of sulfonated alkylated petroleum hydrocarbon (as its neutral calcium salt) and 35% of "synthetic" sulfonated alkylated benzene (as its neutral calcium salt). This petroleum based component is prepared from a petroleum fraction of 300–700 molecular weight which bears a long chain alkyl group (one per molecule) which is sulfonated to yield product containing predominantly one —$SO_3H$ per molecule, followed by neutralizing with calcium hydroxide.

The "synthetic" component is prepared by alkylating benzene with a $C_{10}$–$C_{16}$ aliphatic olefin hydrocarbon to introduce predominantly two such groups per molecule followed by sulfonation to yield product containing one such group per molecule—followed by neutralizing with calcium hydroxide.

This commercially available mixture contains 0.27w % calcium chloride as a result of processing.

(ii) The Witco Cal T-2 brand of a mixture containing the same components as does the Witco Cal-T product —but in equal portions by weight. This product contains no significant amount of calcium chloride.

Also added to the reaction mixture are 0.15–0.5 parts, say 0.27 parts of alkaline earth metal halide. Typically the alkaline earth metal may be barium, strontium, magnesium, or preferably calcium. The halogen may be iodine, bromine, fluorine or preferably chloride. The alkaline earth metal of the alkaline earth metal halide is preferably the same as that of the neutral alkaline earth metal salt of the alkaryl sulfonate—and preferably calcium. The halide is preferably calcium chloride.

Commonly commercially available neutral alkaline earth metal salts of alkaryl sulfonates may contain up to 0.5w %, say 0.27w % of halide impurity; and this halide content may be sufficient to serve as a portion (or in certain cases all) of the needed halide content.

There are then added to the reaction mixture 60–150, preferably 114 parts of hydrocarbon diluent-solvent, typically n-heptane, benzene, toluene, xylene, or gasoline and 10–30 parts, preferably 19.6 parts of a lower $C_1$–$C_5$ normal or branched chain alcohol promoter. Typical alcohols may include ethanol, n-propanol, isopropanol, n-butanol etc, preferably methanol.

There are also preferably added to the reaction mixture 0.10 parts, say 2 parts of diluent oil typified by a pale stock or a solvent neutral oil (SNO) of viscosity at 40° C. of 100–500 SUS. Typical diluent may be 100 SUS hydrofinished pale stock.

Also added to the reaction mixture are 15–30 parts, say 22.7 parts of alkaline earth metal oxide preferably calcium oxide—lime. It is a feature of the process of this invention that calcium hydroxide is not added as a charge material. The quantity of lime added is such that the mole ratio of CaO added to neutralized calcium alkaryl sulfonate charge is less than 10:1 and preferably 8–9.5:1, say 9:1.

The reaction mixture so formed is heated preferably to reflux temperature, typically 50° C.–70° C., preferably 55° C.–65° C., say about 60° C. and maintained at that temperature for 5–30, say 15 minutes. Pressure is 1–5 atmospheres, say 1.1 atmospheres.

It is a feature of the process of this invention that there is then added water in amount of 1.5–3 parts, say 2.2 parts preferably in one aliquot. This corresponds to about 0.2–0.5 moles, say 0.3 moles of total water added per mole of alkaline earth metal oxide, preferably calcium oxide, charged. Immediately thereafter i.e. within 0–30 minutes, say 15 minutes, gaseous carbon dioxide (preferably of substantially 100% purity) is introduced into the reaction mixture as the latter is maintained preferably at reflux temperature. Carbon dioxide is admitted in molar amount less than the molar amount of alkaline earth metal oxide originally present in the reaction mixture. After 130–200 minutes, say 145 minutes, the flow of carbon dioxide is stopped at which time 0.7–0.85, say 0.8 moles of $CO_2$ has been admitted per mole of alkaline earth metal oxide, preferably calcium oxide.

The reaction mixture is filtered at 45° C.–65° C., say 55° C to separate solids, and solvent is stripped off at 80° C.–140° C., say 110° C. The mixture of oil-soluble product in diluent oil is found to have a Total Base Number (TBN) of 290–310, say 300. Infrared spectroscopy shows a symmetric band with a frequency maximum at 865 $cm^{-1}$ indicating the presence of amorphous calcium carbonate.

It is a particular feature of the product of this invention that it may be characterized by the following characteristics:

(i) a desirable low Overbasing OB Ratio of 7–10:1, preferably abut 8.5:1 as measured by the molar ratio $[CaCO_3] \div [SO_3H^{-1}]$ in the final product. This provides a proper balance between the "soap content" and the "alkalinity" (typical prior art products having the same calcium and sulfonate content, are undesirably characterized by a much higher OB Ratio).

(ii) a content of undesirable crystalline calcium carbonate of typically less than 0.5w %;

(iii) a kinematic viscosity at 100° C. of less than about 100 CSt;

(iv) a sulfonate content greater than about 29%, typically 30%–34%, say 32.9%;

(v) a calcium content greater than about 9%, typcally 10%–14%, say 12.1%.

It is a particular feature of the process of this invention that it is characterized by the following:

(i) The volume of solid by-products (which must be disposed of) is typically reduced by about a third and commonly by half. Prior art processes commonly yield a solid volume of about 9–10% of the reaction mixture while the process of this invention commonly yields 6% or less.

(ii) the addition of water, preferably in one aliquot, prior to admission of carbon dioxide, eliminates the need to control water addition during carbon dioxide admission as is true of prior art techniques.

(iii) the elimination of the need to add calcium hydroxide (with the charge calcium oxide) decreases the number of solid charge materials to be controlled.

(iv) the mole ratio of charge calcium oxide to charge calcium alkaryl sulfonate (maintained at less than 10:1) permits attainment of a clear product containing a decreased content of solids.

(v) the undesirable formation of crystalline calcium carbonate (which has low solubility in oils)—which would normally be expected at high CaO content—is prevented.

(vi) engine performance is improved.

The product recovered from stripping is typically a concentrate in diluent oil containing 55–65w %, say 60w % of active materials. Typically it contains 11–13w %, say 12.1w % calcium and 30–34w %, say 32.9w % sulfonate. This product may be added to a lubricating oil of lubricating viscosity in minor effective overbasing amount to provide detergency and alkaline reserve properties. Typically a petroleum-based diesel lubricating oil may be formulated containing 1.5–2w %, say 1.73w % of the additive i.e. 0.18–0.24w %, say 0.21w % of calcium and 0.5–0.66w %, say 0.57w % sulfonate.

Engine performance of the lubricating oil so formulated may be tested in a Caterpillar 1H2 Engine Test—until ring sticking is recorded by ring side clearance loss.

After 120 hours and again after 480 hours, the oil is rated in terms of (i) Total Weighted Demerits (TWD) which is a rating of piston cleaniness as measured by the amount of deposit on grooves and lands and (ii) Top Groove Fill (TGF) which is the percentage of the top groove filled with carbon deposits.

Typically the generally accepted standard is that the % TGF at 420 hours should be less than 45% and the TWD at 420 hours should be less than 140.

It is a feature of the additive systems of this invention that they permit attainment of TGF (at 480 hours) as low as 10–15%, say 14% and of TWD as low as 80–100, say 81.

DESCRIPTION OF SPECIFIC EMBODIMENTS

Practice of the process of this invention will be apparent to those skilled in the art from inspection of the following wherein, as elsewhere in this application, all parts are parts by weight unless otherwise stated.

EXAMPLE I

In this Example which represents the best mode presently known of carrying out the process of this invention, there is added to a reaction mixture (i) 100 parts of the Witco Cal T brand of alkary hydrocarbon sulfonate neutral calcium salt having the characteristics and composition noted supra, (ii) 19.7 parts of methanol, (iii) 22.7 parts of anhydrous calcium oxide, and (iv) 115 parts of n-heptane. The mole ratio of CaO charged to neutralized calcium sulfonate charged is 9:1. This mixture is heated to reflux of 60° C. over 30 minutes and maintained at reflux for 15 minutes.

There is then added in one aliquot 2.2 parts of water; and gaseous carbon dioxide is admitted over 2 hours to the reaction mixture at 60° C. The amount of $CO_2$ admitted is equal to 0.8 moles of $CO_2$ per mole of lime originally present in the reaction mixture. After 145 minutes (at which time 80mole % of the lime had been admitted and reacted), the addition is terminated.

The reaction mixture is filtered and heated to 90° C. to strip it of heptane and methanol yielding a clear liquid having a TBN of 298.09 and Overbasing Ratio of 8.5:1. The infra-red spectrum shows a symmetric band with a frequency maximum at 865 $cm^{-1}$ indicating amorphous calcium carbonate.

EXAMPLE II

In this Example, there is added to a reaction mixture, (i) 100 parts of the Witco Cal T-2 brand of alkaryl hydrocarbon sulfonate neutral calcium salt having the composition and characteristics noted supra, (ii) 120 parts of crude heptane, (iii) 19.6 parts of methanol, (iv) 22.7 parts of anhydrous calcium oxide, and (v) 0.27 parts of calcium chloride. The mole ratio of CaO charged to neutralized alkaryl hydrocarbon calcium sulfonate charged is 9:1. This mixture is heated to 40° C. over 60 minutes and 2.3 parts of water is added.

The reaction mixture is quickly (over 30 minutes) heated to 60° C. reflux temperature, and gaseous carbon dioxide is admitted over 3 hours to the reaction mixture at 60° C. The amount of $CO_2$ admitted is equal to 0.8 moles of $CO_2$ per mole of lime originally present in the reaction mixture. After 180 minutes (at which time 80% of the lime had been admitted and reacted), the agitation is terminated.

The reaction mixture is filtered and heated to 110° C. to strip it of heptane diluent-solvent and methanol promoter to yield a clear liquid having a TBN of 296 and an Overbasing Ratio of 8.5:1. The infra-red spectrum showed a symmetric band with a frequency maximum at 865 $cm^{-1}$ indicating amorphous calcium carbonate.

The lime utilization is 90% and the sulfonate utilization is 100%.

The volume of solids recovered by filtration is ca 4w % in contrast to the typical prior art quantity of ca 9w %.

EXAMPLES III*-IV

In Control Example III*, a control composition is prepared having a TBN of 300 with an Overbasing Ratio of about 20:1 by mixing a neutral calcium salt of an alkaryl sulfonate (TBN 400) with a neutral calcium salt of an alkaryl sulfonate (TBN 0-25) to form a product containing 0.20w % Ca and 0.57w % sulfonate. This composition is added to a standard base oil in amount of 193w %.

In Experimental Example IV, the experimental composition has a TBN number of 300 and contains 0.21w % Ca and 0.57w % sulfonate. The Overbasing Ratio is about 8.5:1. This composition is added to a standard base oil in amount of 173w %.

These products would be expected to perform similarly in the Caterpillar 1H2 diesel engine test. In this Test, low numbers are indicative of better product e.g. fewer demerits.

The Top Groove Fill (TGF) and the Total Weighted Demerits (TWD) are reported after 120 hours and 480 hours.

TABLE

| Caterpillar 1H2 Rating | Control Example III* | Example IV |
|---|---|---|
| 120 h | | |
| % TGF | 19 | 7 |
| TWD | 66 | 39 |
| 480 h | | |
| % TGF | 44 | 14 |
| TWD | 159 | 81 |

From the above Table is apparent that the performance of the product of Example IV (of O4.B. Ratio of 8.5:1) of this invention is substantially better in all instances than is that of the Control Example III* (of O.B. Ratio of 20:1)—despite the fact that the products have the same TBN, calcium content, and sulfonate content and would thus be expected to have similar performance.

Although this invention has been illustrated by reference to specific embodiments, it will be apparent to those skilled in the art that various charges and modifications may be made which clearly fall within the scope of the invention.

What is claimed is:

1. The method of preparing overbased composition containing an oil-soluble alkaline earth metal salt of an alkaryl sulfonate which comprises (i) forming a reaction mixture containing a neutral alkaline earth metal salt of an alkaryl sulfonate, an alkaline earth metal halide, a hydrocarbon diluent-solvent, a lower alkanol promoter, and an alkaline earth metal oxide said mixture being characterized by a mole ratio of alkaline earth metal oxide: neutral alkaline earth metal salt of an alkaryl sulfonate of less than about 10:1;

(ii) heating said reaction mixture to 50° C.–70° C.;

(iii) adding water to said heated reaction mixture;

(iv) after termination of water addition, admitting gaseous carbon dioxide to said reaction mixture in molar amount less than the molar amount of alkaline earth metal oxide originally present in said reaction mixture thereby forming an overbased composition containing an oil-soluble alkaline earth metal salt of an alkaryl sulfonate characterized by low content of crystalline alkaline earth metal carbonate; and (v) recovering said overbased composition containing an oil-soluble alkaline earth metal salt of an alkaryl sulfonate.

2. The method claimed in claim 1 wherein said alkaline earth metal is calcium.

3. The method claimed in claim 1 wherein the alkaryl component of said alkaryl sulfonate has a molecular weight of 300–700.

4. The method claimed in claim 1 wherein said alkaline earth metal halide is calcium chloride.

5. The method claimed in claim 1 wherein said water is added to said heated reaction mixture in amount of 1.5–3 parts per 100 parts of neutral alkaline earth metal salt of alkaryl sulfonate originally charged to said reaction mixture.

6. The method claimed in claim 1 wherein said water is added to said heated reaction mixture in one aliquot.

7. The method claimed in claim 1 wherein said gaseous carbon dioxide is admitted starting at a time less than 30 minutes after the water is added to said heated reaction mixture.

8. The method of preparing overbased composition containing an oil-soluble calcium salt of an alkaryl sulfonate which comprises (i) forming a reaction mixture containing a neutral calcium salt of an alkaryl sulfonate, calcium chloride, hydrocarbon diluent-solvent, methanol promoter, and calcium oxide, said reaction mixture having been formed without addition thereto of calcium hydroxide;

(ii) heating said reaction mixture to 55° C.–65° C.;

(iii) adding water to said heated reaction mixture;

(iv) after termination of water addition, admitting gaseous carbon dioxide to said reaction mixture in molar amount less than the molar amount of calcium oxide originally added to said reaction mixture thereby forming an overbased composition containing an oil-soluble calcium alkaryl sulfonate in a reaction mixture characterized by an Overbasing Mole Ratio $[CaCO_3] \div [SO_3H^-]$ of about 7–10:1; and (v) recovering said overbased composition containing an oil-soluble calcium alkaryl sulfonate in a reaction mixture characterized by an Overbasing Mole Ratio $[CaCO_3] \div [SO_3H^-]$ of about 7–10:1.

9. An overbased composition containing an oil-soluble alkaline earth metal salt of an alkaryl sulfonate prepared by the process which comprises (i) forming a reaction mixture containing a neutral alkaline earth metal salt of an alkaryl sulfonate, an alkaline earth metal halide, a hydrocarbon diluent-solvent, a lower alkanol promoter, and an alkaline earth metal oxide;

(ii) heating said reaction mixture to 50° C.–70° C.;

(iii) adding water to said heated reaction mixture;

(iv) after termination of water addition, admitting gaseous carbon dioxide to said reaction mixture in amount molar of less than the molar amount of alkaline earth metal oxide originally present in said reaction mixture thereby forming an overbased composition containing an oil-soluble alkaline earth metal salt of an alkaryl sulfonate; and (v) recovering said overbased composition containing an oil-soluble alkaline earth metal salt of an alkaryl sulfonate.

10. An overbased composition containing an oil-soluble calcium salt of an alkaryl sulfonate prepared by the process which comprises (i) forming a reaction mixture containing a neutral calcium salt of an alkaryl sulfonate, calcium chloride, hydrocarbon diluent-solvent, methanol promoter, and calcium oxide, said reaction mixture having been formed without addition thereto of calcium hydroxide;

(ii) heating said reaction mixture to 55° C.–65° C.;

(iii) adding water to said heated reaction mixture;

(iv) after termination of water addition, admitting gaseous carbon dioxide to said reaction mixture in molar amount less than the molar amount of calcium oxide originally added to said reaction mixture thereby forming an overbased composition containing an oil-soluble calcium alkaryl sulfonate in a reaction mixture characterized by an Overbase Mole Ratio $[CaCO_3] \div [SO_3H^-]$ of about 7–10:1; and (v) recovering said overbased composition containing an oil-soluble calcium alkaryl sulfonate in a reaction mixture characterized by an Overbase Mole Ratio $[CaCO_3] \div [SO_3H^-]$ of about 7–10:1.

11. A lubricating oil containing a major amount of an oil of lubricating viscosity and a minor effective overbasing amount of a composition prepared by the process which comprises (i) forming a reaction mixture containing a neutral alkaline earth metal salt of an alkaryl sulfonate, an alkaline earth metal halide, a hydrocarbon diluent-solvent, a lower alkanol promoter, and an alkaline earth metal oxide;

(ii) heating said reaction mixture to 50° C.–70° C.;

(iii) adding water to said heated reaction mixture;

(iv) after termination of water addition, admitting gaseous carbon dioxide to said reaction mixture in molar amount less than the molar amount of alkaline earth metal oxide originally present in said reaction mixture thereby forming an overbased composition containing an oil-soluble alkaline earth metal salt of an alkaryl sulfonate; and (v) recovering said overbased composition containing an oil-soluble alkaline earth metal salt of an alkaryl sulfonate.

* * * * *